US010856639B2

(12) United States Patent
Molayev et al.

(10) Patent No.: US 10,856,639 B2
(45) Date of Patent: Dec. 8, 2020

(54) STYLING HAIR DRYER NOZZLE

(71) Applicants: Beny Molayev, Lawrence, NY (US); Roni Yosef, Henderson, NV (US)

(72) Inventors: Beny Molayev, Lawrence, NY (US); Roni Yosef, Henderson, NV (US)

( * ) Notice: Subject to any disclaimer, the term of this patent is extended or adjusted under 35 U.S.C. 154(b) by 201 days.

(21) Appl. No.: 15/426,314

(22) Filed: Feb. 7, 2017

(65) Prior Publication Data

US 2018/0220767 A1 Aug. 9, 2018

(51) Int. Cl.
*A45D 20/12* (2006.01)
*A45D 7/02* (2006.01)

(52) U.S. Cl.
CPC ..... *A45D 20/122* (2013.01); *A45D 7/02* (2013.01)

(58) Field of Classification Search
CPC .... A45D 20/122; A45D 20/12; A45D 20/124; A45D 20/50; A45D 20/10
See application file for complete search history.

(56) References Cited

U.S. PATENT DOCUMENTS 6,009,883 A * 1/2000 Morrow ..... A45D 2/001 132/211
2004/0047620 A1* 3/2004 Ruben ..... A45D 20/122 392/385
2005/0229423 A1* 10/2005 Keong ..... A45D 20/12 34/96
2012/0234343 A1* 9/2012 Cohen ..... A45D 20/12 132/271

* cited by examiner

*Primary Examiner* — Rachel R Steitz
*Assistant Examiner* — Brianne E Kalach
(74) *Attorney, Agent, or Firm* — Israel Nissenbaum; Yitzy Nissenbaum

(57) ABSTRACT

A device which maintains exit temperature of hot air from a hair dryer passing through a nozzle attachment seated on the hair dryer. The hair dryer heats air and blows it out of an opening, with the nozzle attachment seated on the hair dryer opening. The nozzle attachment channels the heated air from the hair dryer opening to and out of a narrowed slotted opening in the nozzle attachment. The device comprises a heat conductive element configured to be securely seated on an interior surface of the nozzle attachment at a position adjacent the narrow slotted opening in the nozzle attachment without substantially impeding heated air from exiting the slotted opening. The heat conductive element is of sufficient dimensions to substantially maintain hot air exit temperature from the hair dryer opening as it exits the slotted opening of the nozzle attachment, without significant heating of the nozzle attachment.

7 Claims, 7 Drawing Sheets

STYLING HAIR DRYER NOZZLE

FIELD OF THE INVENTION

This invention relates to hair styling hair dryers or blowers such as used in hair salons or by consumer users at home and relates particularly to nozzles used with such hair dryers.

BACKGROUND

Hair dryers are used in hair salons and by consumer users at home to dry hair and often to style the hair with such drying. For drying purposes the commonly available hair dryers (whether consumer type or professional type) generally have circular blower opening for the emission of heated air to the wet hair to effect accelerated moisture vaporization and drying.

The hair dryers are often provided with styling nozzles which are configured to be fitted onto the circular blower opening to concentrate the emitted hot air in a slotted opening configuration. The typical styling nozzle is configured with a circular tube sized to fit over the blower end of a hair dryer and then gradually extends with a taper into a somewhat elongated rectangular nozzle slot (some nozzles have curve slots but these are not as preferred for styling). Hot air emitted from the hair dryer is thereby directed to a controlled narrow area. Since the slotted end of the nozzle is thus distanced from the blower end there is a heat loss in the hot air as it travels and exits the nozzle.

In styling operation the slotted nozzle is held in close proximity to the hair while it is being styled in successive drying states with continued nozzle movement. For safety purposes hair dryers (at least the sections in contact with blowing hot air) and nozzles are made of non-heat conductive materials such as heat resistant structural plastics. However, because of its non-heat-conductance, hot air emitted from the hair dryer through the normally supplied nozzles is cooled down from its originally generated temperature of about 190 degrees F. to about 170 degrees F. at the nozzle opening as it travels from the dryer. A higher temperature (or a retention of original heat) is however desirable to provide a faster and more efficient sealing of the hair as it is being styled, in order to set and retain the styled hair.

SUMMARY OF THE INVENTION

It is an object of the present invention to provide an add-on device for hair dryer nozzles which enables the nozzle exit hot air temperature to be increased (or with heat being retained) by at least ten degrees from its normal nozzle exit temperature without compromising safety of the user.

It is a further object of the present invention to provide a nozzle for a hair dryer which initially is made with or which is integrated with a hair dryer nozzle attachment.

It is a still further object of the invention to provide a method for facilitating hair styling with a hair dryer by increasing the effective temperature of hot air emitted from a hair dryer nozzle attachment.

Generally the present invention comprises a method and device for substantially maintaining the temperature of hot air initially exiting from a hair dryer through and eventually exiting from a hair dryer nozzle attachment affixed to the hair dryer. The final hot air temperature exiting from the nozzle attachment is substantially maintained relative to the original generated hot air and this facilitates hair sealing and hair styling.

The device substantially maintains exit temperature of hot air from a hair dryer which passes through a non-heat conductive nozzle attachment operationally seated on the hair dryer. The hair dryer has elements therein for heating air and for blowing the heated air out of an opening, with the nozzle attachment being configured to be seated on the hair dryer opening. The nozzle attachment typically has a structure which channels the heated air from the hair dryer opening to and out of a narrowed slotted opening in the nozzle attachment. An embodiment of the temperature maintaining device herein comprises a heat conductive element configured to be securely seated on an interior surface of the nozzle attachment at a position adjacent the narrow slotted opening in the nozzle attachment without substantially impeding heated air from exiting the slotted opening. The heat conductive element is of sufficient dimensions to substantially maintain hot air exit temperature from the hair dryer opening as it exits the slotted opening of the nozzle attachment, without significant heating of an exterior surface of the nozzle attachment.

In a further embodiment of the invention the device comprises a lip element configured to be seated on an external edge of the slotted opening for the secure seating. In a further embodiment, the device is comprised of a continuous substantially elongated rectilinear element conformed to fittingly engage the inner surface of the nozzle attachment adjacent the slotted opening. The rectilinear element has side openings parallel to the slotted opening with the side openings being of sufficient dimensions to permit heated air to pass through the slotted opening substantially without impeding air flow. The rectilinear element has side walls which closely engage the interior surface of the nozzle attachment and which extend within the nozzle attachment for a distance sufficient to provide heat conduction with contact of the heated air to result in the substantially maintaining of the exit temperature from the nozzle attachment. The device is either removable from the nozzle attachment such as for use with other nozzle attachments or it may be non-removably integrated with the nozzle attachment The method for facilitating hair styling with a hair dryer and a narrow slot nozzle attachment seated thereon, comprises the step of attaching the device of claim 1 to the nozzle attachment and using the nozzle attachment with heated air exiting therefrom and the heated device on hair segments and sealing and styling the hair segment therewith.

The above objects, features and advantages of the invention will become more evident from the following discussion and drawings in which:

SHORT DESCRIPTION OF THE DRAWINGS

Figure 5:
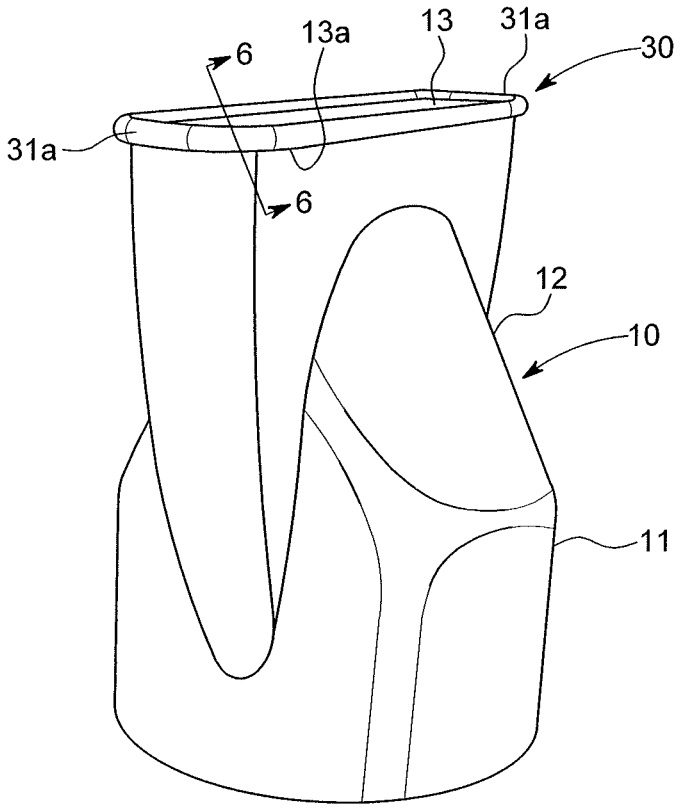
FIG. 5 is a perspective view of a nozzle of the type shown in FIG. 2 with an inserted sleeve of FIG. 4.
Figure 7A:
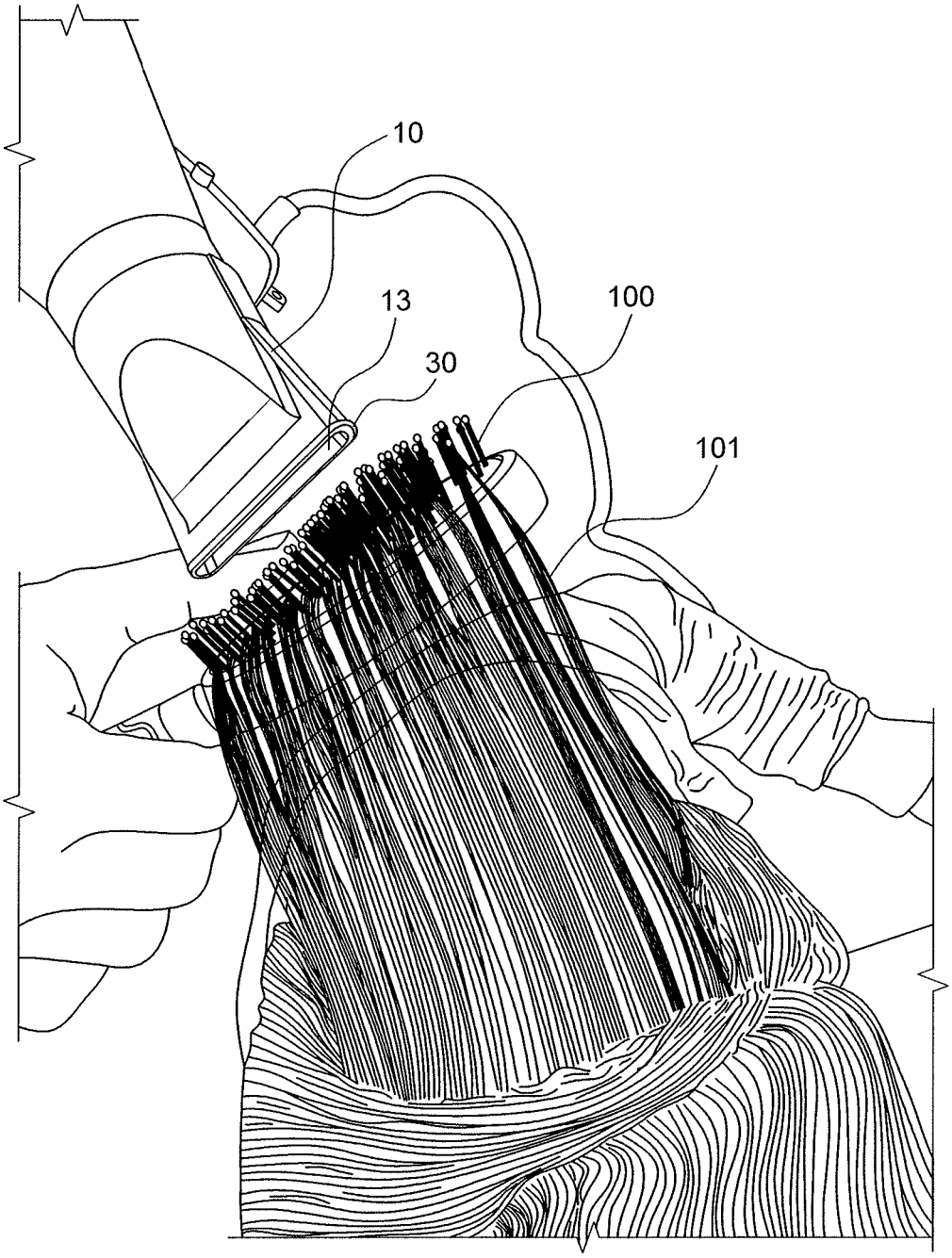
Figure 7B:
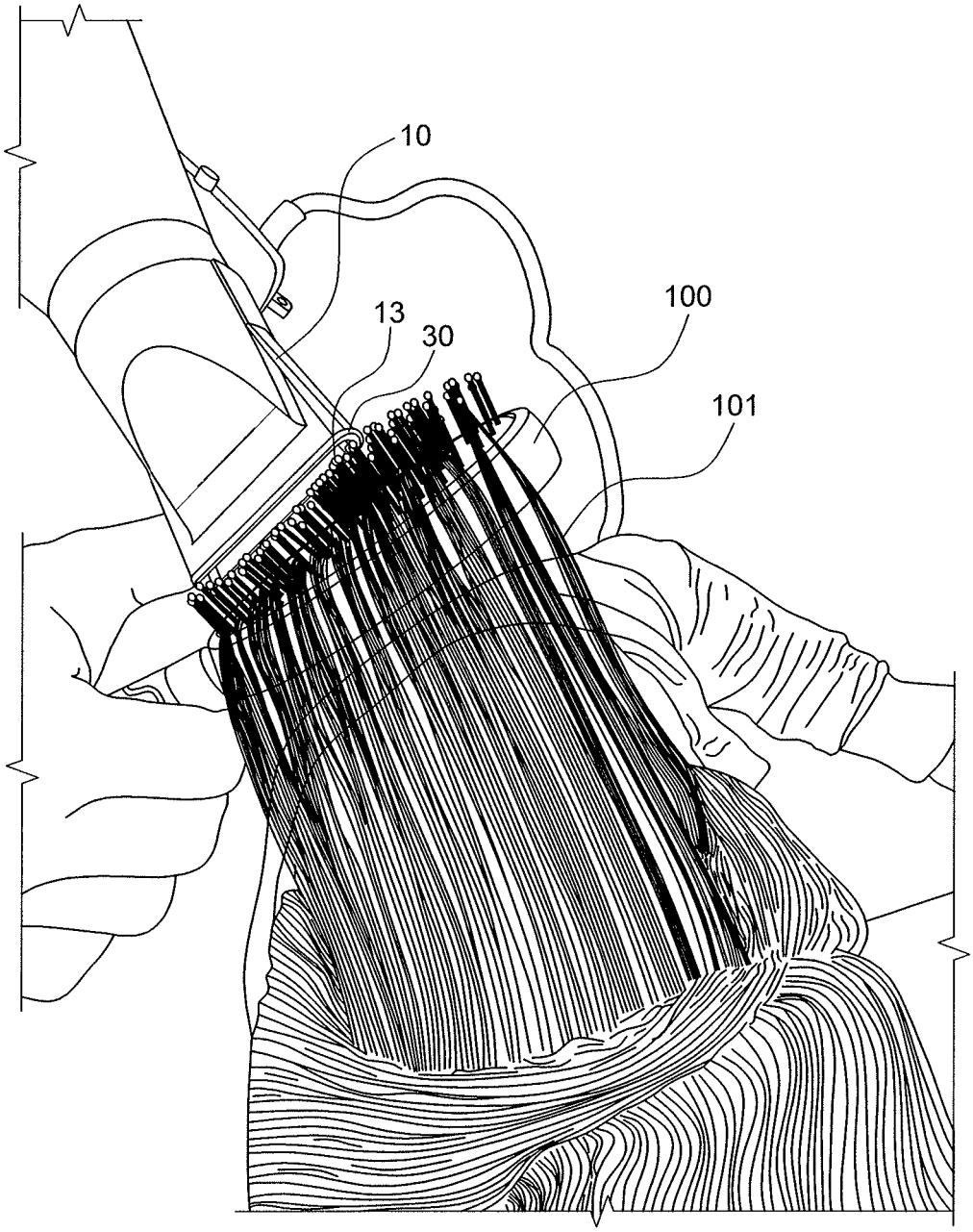

FIGS. 7*a* and 7*b* are views of the hair dryer with nozzle of FIG. 5 as utilized on hair being stylized.

DETAILED DESCRIPTION

The device comprises a heat conductive sleeve for a hair dryer nozzle configured to be snugly inserted through the nozzle opening and to circumferentially extend along an inner surface perimeter of the nozzle and inwardly extend along a longitudinal distance for a distance sufficient to conduct hair dryer heat, as emitted, to an overlying lip of the sleeve at the end of the nozzle at its exit opening. With prior art nozzles, heat is effectively dissipated at the nozzle exit to about 170 degrees F. and the heat conductive sleeve The heated lip is applied directly or proximate to the hair being styled to facilitate the styling at the higher conducted temperature which is close to the temperature of the air originally emitted from the hair dryer. Because of the small surface area of the heated lip and its end rather than lateral location, the hair stylist and/or person having the hair style is not significantly exposed to any safety and inadvertent burning problems. The positioning of the heat conductive device primarily within the non-heat conductive nozzle enables the nozzle to still fully provide protection from inadvertent burning. Heat conductive materials are primarily metals, such zinc alloy of varying softness and smoothness which can efficiently both conduct heat and smooth hair being styled. Thickness of the metal or heat conductive sleeve is sufficient to maintain structural integrity and position of the sleeve while being brought into continued contact with hair being stylized. It should also have a thickness, depending on the specific material and heat conductivity of the heat conductive sleeve to provide an increase of nozzle air exit temperature (generally about 170 degrees F.) of at least 5 to 10 degrees F.

The method of the invention comprises the step of providing a heat conductive element within an insulated hair dryer nozzle attachment which is exposed to hot air emitted from the hair dryer whereby heated air in the area of the nozzle loses a minimal amount of heat with the conducted heat to the exit point of the nozzle. The method comprises a further step of providing a heat conductive lip element on the nozzle opening edge whereby heat conduction thereto elevates the emitted hot air temperature.

Figure 1:
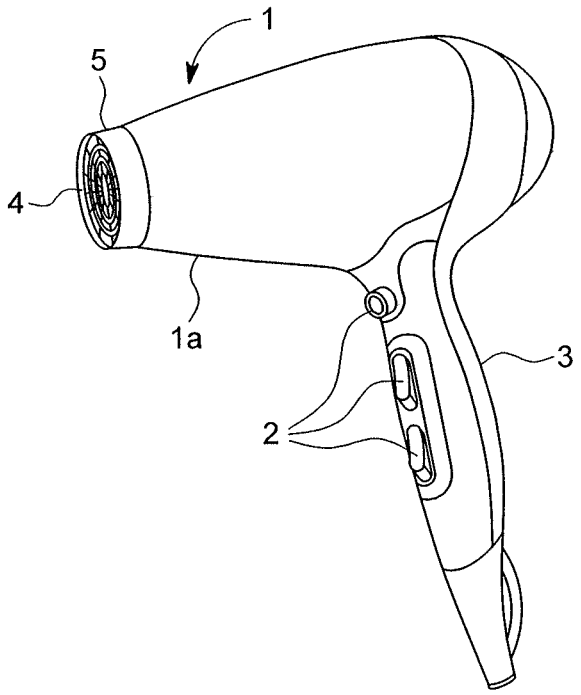
FIG. 1 is a side isometric view of a typical prior art electric hair dryer.
Figure 2:
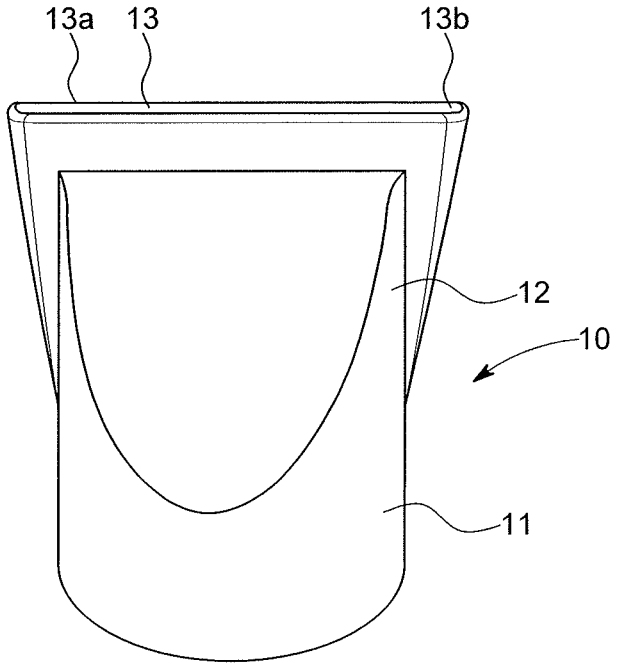
FIG. 2 is a front view of a prior art nozzle styling attachment for use with the hair dryer of FIG. 1.
Figure 3:
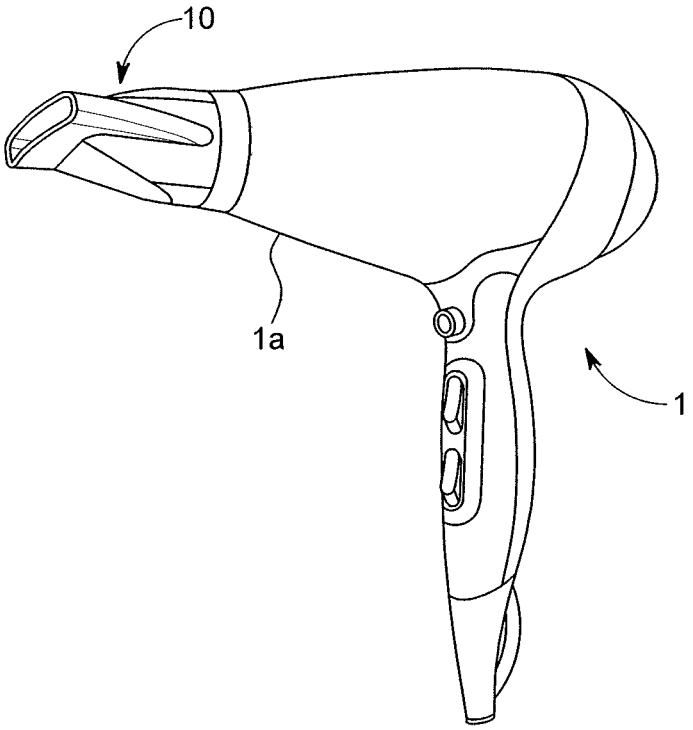
FIG. 3 depicts the hair styling nozzle attachment of FIG. 2 as emplaced on the hair dryer of FIG. 1.

As shown in FIG. 1, a typical prior art hair dryer 1 is comprised of a non-heat conductive structural plastic with controls 2 on a handle 3. When activated, hot air is generated internally by electrically resistive elements and an internal fan (not shown) blows the hot air out of opening 4 having a grating 5 to safely prevent accidental finger insertion. The hair dryer nozzle attachment 10 is shown in FIG. 2 with cylindrical section 11 configured and sized to fit onto the hair dryer adjacent opening 4 of the hair dryer with hot air generated by the hair dryer being funneled through the nozzle 10 with tapered section 12 and out of narrowed slot 13. FIG. 3 depicts the hair dryer 1 with emplaced nozzle 10 positioned along the width of the hair dryer barrel 1*a*.

Figure 4:
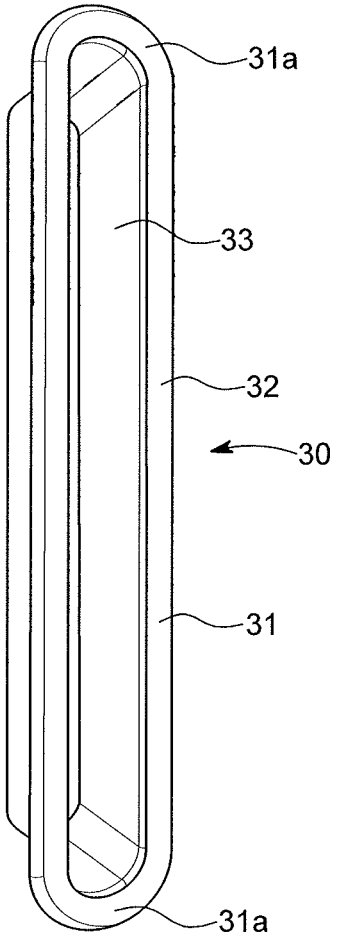
FIG. 4 is the heat conductive sleeve of the present invention.

Sleeve 30 shown in FIG. 4 is comprised of a continuous elongated rectilinear open sided form 31 with rounded ends 31*a* configured to snugly conform to the inner area of the nozzle 13*a* adjacent the slot opening 13. A rectilinear continuous bead 32 is formed on an open side of the sleeve 30 and is sized and outwardly extended to be fully seated on lip 13*b* of the opening of slot 13 when seated on the nozzle, as shown in FIG. 5. Cross section 6-6 of FIG. 6 shows the downward or inward extension 33 of rectilinear form 31 as it extends within nozzle 10 to a position proximate to the point 14 at which the tapered section 12 leads into the walls 13*c* of slot 13.

Figure 6:
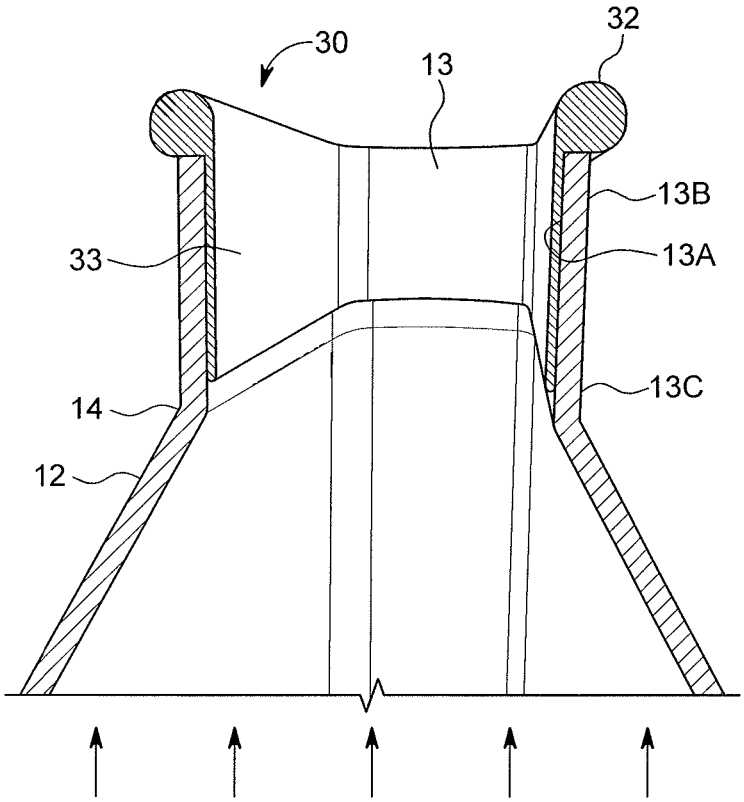
FIG. 6 is a cross section view 6-6 of the nozzle with inserted sleeve of FIG. 5.

Hot air flows in the direction of the arrows in FIG. 6 from the end of the hair dryer opening 4 as inserted into nozzle cylindrical section 11, with a portion of the hot air initially hitting tapered section 12 of the nozzle as it is funneled to exit from slot 13. The hot air then engages with walls 13*c* of the slot and the heat conductive extension 33 of sleeve 30. Bead 32, with heat conduction, is at about the temperature at which the hot hair initially engages conductive extension 33 with the heat conductivity of the walls of the extension 33 substantially maintaining the heat of the hot air within the narrowed air exit of slot 13.

As shown in FIGS. 7*a* and 7*b*, the hair styling procedure is effected with a brush 100 used to engage, stretch and pull a section 101 of a person's wet hair outwardly with the hair dryer 1 being activated to blow hot air through nozzle attachment 10 and brought into proximate contact with the hair section as sequentially shown in FIGS. 7*a* and 7*b*. The nozzle slot 13, with heat conductive sleeve 30, is shown as being brought into engagement with the hair section 101 whereby the hot air and the heated bead dries and seals the hair for styling. The increased hot air temperature and heated bead temperature provide for a quicker and more efficient drying, sealing and styling than was possible with the standard plastic nozzle attachment alone.

It is understood that the above description and drawings are only illustrative of the invention and that changes in structure, elements, materials and the like may be made without departing from the scope of the invention as defined by the following claims.

What is claimed is:

1. A device, in combination with a nozzle attachment for a hair dryer, the device configured to substantially maintain exit temperature of hot air discharged from a hair dryer through a non-heat conductive hollow nozzle attachment comprised of a tapered portion and a narrowed distal portion terminating in an opening edge, the nozzle seated on an opening of the hair dryer, wherein the device comprises:

a hollow heat conductive element formed of heat-conducting metal, comprising a planar portion configured to form an internal cladding surface for the nozzle attachment, extending to a distal end thereof, the cladding formed by opposing rectilinear surfaces connected by rounded end sections forming a hollow circumferential surface configured to match an internal shape of the nozzle attachment to which it is configured to engage;

a projecting lip portion, configured to extend outward from the distal end such that the projecting lip portion is configured to he seated entirely outward and beyond an opening edge of the nozzle, forming an outer terminal end of the nozzle attachment.

2. The device, in combination with a nozzle attachment, of claim 1, wherein the lip element is configured to be seated on an external edge of the opening edge.

3. The device, in combination with a nozzle attachment, of claim 2, wherein the device comprises a continuous shape configured to have sufficient dimensions to permit heated aft to pass through the opening edge without any impeding of the air.

4. The device of claim 1, in combination with a nozzle attachment, the device is configured to be integrated with the nozzle attachment.

5. The device of claim 1, in combination with a nozzle attachment, the device is configured to be removably attached to the nozzle attachment.

6. The device of claim 1, in combination with a nozzle attachment, for a hair dryer, for use in hair styling, the device forming a narrowed slot at its distal end.

7. A method for facilitating hair styling with a hair dryer and the device of claim, comprising the step of using the nozzle attachment with heated air exiting therefrom and the heated device on hair segments and sealing and styling the hair segment therewith.

* * * * *